US011555334B2

(12) United States Patent
Singh

(10) Patent No.: US 11,555,334 B2
(45) Date of Patent: Jan. 17, 2023

(54) ELECTRONIC ACCESS CONTROL STRIKE AND PRELOAD RESISTANT MODULE THEREFORE

(71) Applicant: DORMAKABA CANADA INC., Montréal (CA)

(72) Inventor: Mandeep Singh, Kitchener (CA)

(73) Assignee: DORMAKABA CANADA INC., Montréal (CA)

( * ) Notice: Subject to any disclaimer, the term of this patent is extended or adjusted under 35 U.S.C. 154(b) by 283 days.

(21) Appl. No.: 16/636,811

(22) PCT Filed: Sep. 13, 2018

(86) PCT No.: PCT/CA2018/051131
§ 371 (c)(1),
(2) Date: Feb. 5, 2020

(87) PCT Pub. No.: WO2019/051594
PCT Pub. Date: Mar. 21, 2019

(65) Prior Publication Data

US 2020/0370337 A1 Nov. 26, 2020

Related U.S. Application Data

(60) Provisional application No. 62/558,434, filed on Sep. 14, 2017.

(51) Int. Cl.
*E05B 47/00* (2006.01)

(52) U.S. Cl.
CPC ..... *E05B 47/0047* (2013.01); *E05B 47/0012* (2013.01)

(58) Field of Classification Search
CPC .. E05B 47/00; E05B 47/0001; E05B 47/0047; E05B 47/0046; E05B 2047/0014;
(Continued)

(56) References Cited

U.S. PATENT DOCUMENTS 4,211,443 A 7/1980 Butts et al.
6,076,870 A 6/2000 Frolov
(Continued)

FOREIGN PATENT DOCUMENTS

CA 2821821 A1 6/2012
CA 2727975 C 8/2015
CA 2880398 A1 7/2017

*Primary Examiner* — Christine M Mills
*Assistant Examiner* — Peter H Watson
(74) *Attorney, Agent, or Firm* — Alexandre Daoust; Norton Rose Fulbright LLP

(57) ABSTRACT

The electronic access control strike can have a bolt socket, a bolt path leading to bolt socket, a keeper movably mounted to a frame in a manner to be moveable into and out of interference with the bolt path, a cam member moveable for selectively blocking or unblocking the movement of the keeper, and an anti-preload member which is moveable into interference between the keeper and the cam member for preventing the keeper from conveying a preload force onto the cam member when the cam member is in the blocking position, and moveable out from interference between the keeper and the cam member when the cam member is in the unblocking position to allow the keeper to be moved out from interference with the bolt path.

9 Claims, 15 Drawing Sheets

(58) Field of Classification Search
CPC ..... E05B 2047/0015; E05B 2047/0018; E05B 47/0002; E05B 47/0003; E05B 47/0004; E05B 2047/0016; E05B 2047/0024; E05B 47/0012; E05B 2047/0017; E05B 2047/0025; E05B 2047/0036; Y10T 292/68; Y10T 292/696; Y10T 292/699; Y10T 292/702
See application file for complete search history.

(56) References Cited

U.S. PATENT DOCUMENTS 6,082,791 A 7/2000 Frolov et al.
6,330,817 B1 12/2001 Frolov
6,935,663 B2 * 8/2005 Schildwachter .... E05B 47/0047 52/745.15
7,980,603 B2 7/2011 Peabody et al.
8,454,063 B2 6/2013 David et al.
8,544,895 B2 10/2013 Webb et al.
8,833,814 B2 * 9/2014 Chang ..... E05B 47/0047 292/341.15
8,851,532 B2 * 10/2014 Geringer ..... E05B 47/00 292/200
2004/0061343 A1 * 4/2004 Bashford ..... E05B 47/0047 292/341.16
2004/0207210 A1 10/2004 Luker
2006/0226663 A1 * 10/2006 Liao ..... E05B 47/0047 292/341.16
2010/0038920 A1 2/2010 Tsai
2010/0212373 A1 8/2010 Wheeler
2011/0036131 A1 2/2011 Chou et al.
2013/0328332 A1 12/2013 Scheffler et al.
2014/0367978 A1 12/2014 Geringer et al.
2015/0167351 A1 6/2015 Singh et al.
2017/0067271 A1 * 3/2017 Schroeder ..... E05C 3/24
2019/0040654 A1 * 2/2019 Dirnberger ..... D06F 37/42

* cited by examiner

ELECTRONIC ACCESS CONTROL STRIKE AND PRELOAD RESISTANT MODULE THEREFORE

FIELD

The improvements generally relate to the field of physical access control, and more specifically to electronic access control strikes.

BACKGROUND

Electronic access control strikes are a type of strike in which the keeper is normally blocked and prevents movement of the bolt out of the bolt socket, thereby preventing the opening of the associated door. The strike is provided with an actuator which allows to unblock the keeper. An input module is provided to receive a user input, and some form of authenticating function is provided which triggers the unblocking of the keeper via the actuator only if the user input is authenticated.

Various models of electronic access control strikes are available on the market, the details of which can vary. For instance, some electronic access control strikes have a pivotable keeper, others have a slidable keeper, some use keypads for user input, others use card readers (e.g. RFID), and some others use more elaborate forms of user input such as fingerprint readers or retinal scanners for instance, but some generalities of electronic access control strikes are constant from one model to another. These devices are commonly referred to as electronic access control strikes as they typically (but not necessarily) involve some form of electronics to perform the input receiving, authenticating, and/or controlling functions. Moreover, some or all of these functions can be performed or assisted by some form of computer.

A problem encountered in many applications is that in some cases, a force, which will be referred to herein as a preloading force, is exerted by the door, and more specifically the bolt, onto the keeper, which jams the keeper unblocking mechanism, and prevents the normal keeper unblocking action upon authentication of the user input. Such a force can have various sources: air pressure from the HVAC system, twisted door frames, warped doors, thick weather strippings are a few examples.

Accordingly, while existing electronic access control strikes were satisfactory to a certain degree, there remained room for improvement.

SUMMARY

There is provided a mechanism which can be referred to herein as an anti-preload mechanism, or preload negating mechanism, which can be coordinated with the keeper unblocking function in a manner to avoid an occurrence of the preload force when the keeper unblocking mechanism is operated. In one variant, a an anti-preload member is positioned in the preloading path of the keeper to prevent the preload from occuring. In another variant, an anti-preload member is driven to exert a force counteracting the preloading force on the keeper when the unblocking function operates. Accordingly, at the time when the unblocking function operates, the preloading force which would otherwise jam the unblocking function is not active, and the unblocking function can operate normally. In one variant, the anti-preload member is biased into the preloading path, and can be locked into or unlocked from that position by a motor driven mechanism. When it is locked in that position, the preload force acts against the anti-preload member, which reacts with a countering force, rather than acting against the keeper unblocking mechanism. When it is unlocked from that position, the keeper can push the anti-preload member out from interference and proceed to the freeing of the bolt. In another embodiment, an unblocking force is exerted by a rotary motor which is provided with an anti-preload member which is pivoted by the rotary motor, against the keeper, to exert a preload-countering force. The keeper can be designed with a specific engagement feature designed to receive the anti-preload member and the associated preload-countering force. The motor can be manufactured as an integral part of an electronic access control strike. Alternately, the motor can be provided in a preload-countering module configured to be installed (retrofitted) on an existing electronic access control strike.

In accordance with one aspect, there is provided an electronic access control strike having a bolt socket, a bolt path leading to bolt socket, a keeper movably mounted to a frame in a manner to be moveable into and out of interference with the bolt path, a cam member moveable for selectively blocking or unblocking the movement of the keeper, and an anti-preload member which is moveable into interference between the keeper and the cam member for preventing the keeper from conveying a preload force onto the cam member when the cam member is in the blocking position, and moveable out from interference between the keeper and the cam member when the cam member is in the unblocking position to allow the keeper to be moved out from interference with the bolt path.

In accordance with another aspect, there is provided a method of operating an electronic access control strike having a bolt area, a bolt path leading to bolt area, a keeper movably mounted to a frame in a manner to be moveable into and out of the bolt path, a cam member moveable for selectively blocking or unblocking the movement of the keeper out of the bolt path, an actuator for driving the movement of the cam member, an anti-preload member moveable into interference between the keeper and the cam member, a motor controlling the movement of the anti-preload member, the method comprising: receiving a user input, authenticating the user input against credential data, and contingent upon said authentication: operating the actuator to move the cam member for unblocking the movement of the keeper while the anti-preload member is in interference between the keeper and the cam member.

In accordance with one aspect, there is provided an electronic access control strike having a bolt socket, a bolt path leading to the bolt socket, a keeper movably mounted to a frame in a manner to be moveable into and out of interference with the bolt path, a cam member moveable for selectively blocking or unblocking the movement of the keeper, an actuator for driving the movement of the cam member and a motor connected to a pivotable member, the pivotable member being pivotable by the motor into engagement with the keeper to exert a force against the keeper and move the keeper away from the cam member.

In accordance with another aspect, there is provided a preload negating module for an electronic access control strike, the preload negating module having a frame mountable to a frame of the electronic access control strike and a motor mounted to the frame and connected to a pivotable member, the pivotable member being pivotable by the motor in a manner that when the frame of the preload negating module is mounted to the frame of the electronic access control strike, the pivotable member is pivotable into engagement with a keeper of the electronic access control strike to exert a preload negating force against the keeper.

In accordance with another aspect, there is provided a method of operating an electronic access control strike having a bolt area, a bolt path leading to bolt area, a keeper movably mounted to a frame in a manner to be moveable into and out of the bolt path, a cam member moveable for selectively blocking or unblocking the movement of the keeper, an actuator for driving the movement of the cam member and a motor connected to a pivotable member, the method comprising: receiving a user input, authenticating the user input against credential data, and contingent upon said authentication: controlling the motor to pivot the pivotable member in a manner for the pivotable member to exert a force against the keeper and move the keeper away from the cam member, and operating the actuator to move the cam member for unblocking the movement of the keeper while the force is exerted by the pivotable member against the keeper.

It will be understood that the expression 'computer' as used herein is not to be interpreted in a limiting manner. It is rather used in a broad sense to generally refer to the combination of some form of one or more processing units and some form of memory system accessible by the processing unit(s). Similarly, the expression 'controller' as used herein is not to be interpreted in a limiting manner but rather in a general sense of a device, or of a system having more than one device, performing the function(s) of controlling one or more motor(s), actuator(s) or the like.

It will be understood that the various functions of the computer, or more specifically of the processing unit, or of a controller, can be performed by hardware, by software, or by a combination of both. For example, hardware can include logic gates included as part of a silicon chip of the processor. Software can be in the form of data such as computer-readable instructions stored in the memory system. With respect to a computer, a controller, a processing unit, or a processor chip, the expression 'configured to' relates to the presence of hardware, software, or a combination of hardware and software which is operable to perform the associated functions.

Many further features and combinations thereof concerning the present improvements will appear to those skilled in the art following a reading of the instant disclosure.

DESCRIPTION OF THE FIGURES

In the figures.

DETAILED DESCRIPTION

Figure 1A:
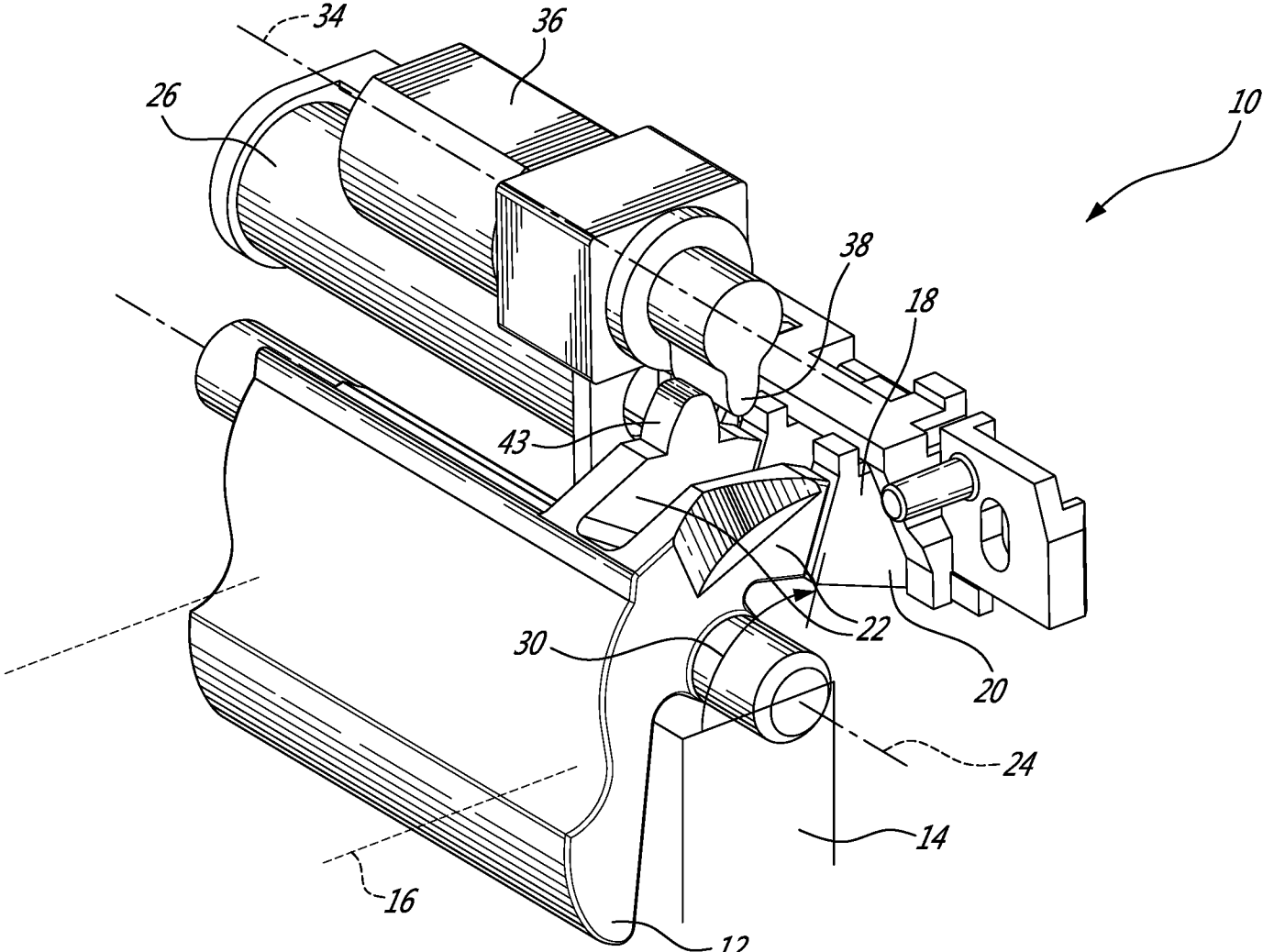
FIGS. 1A to 1C are sequential oblique views showing components of the electronic access control strike A) during preload, B) countering pre-load, and C) unblocking, in accordance with a first embodiment.
Figure 1B:
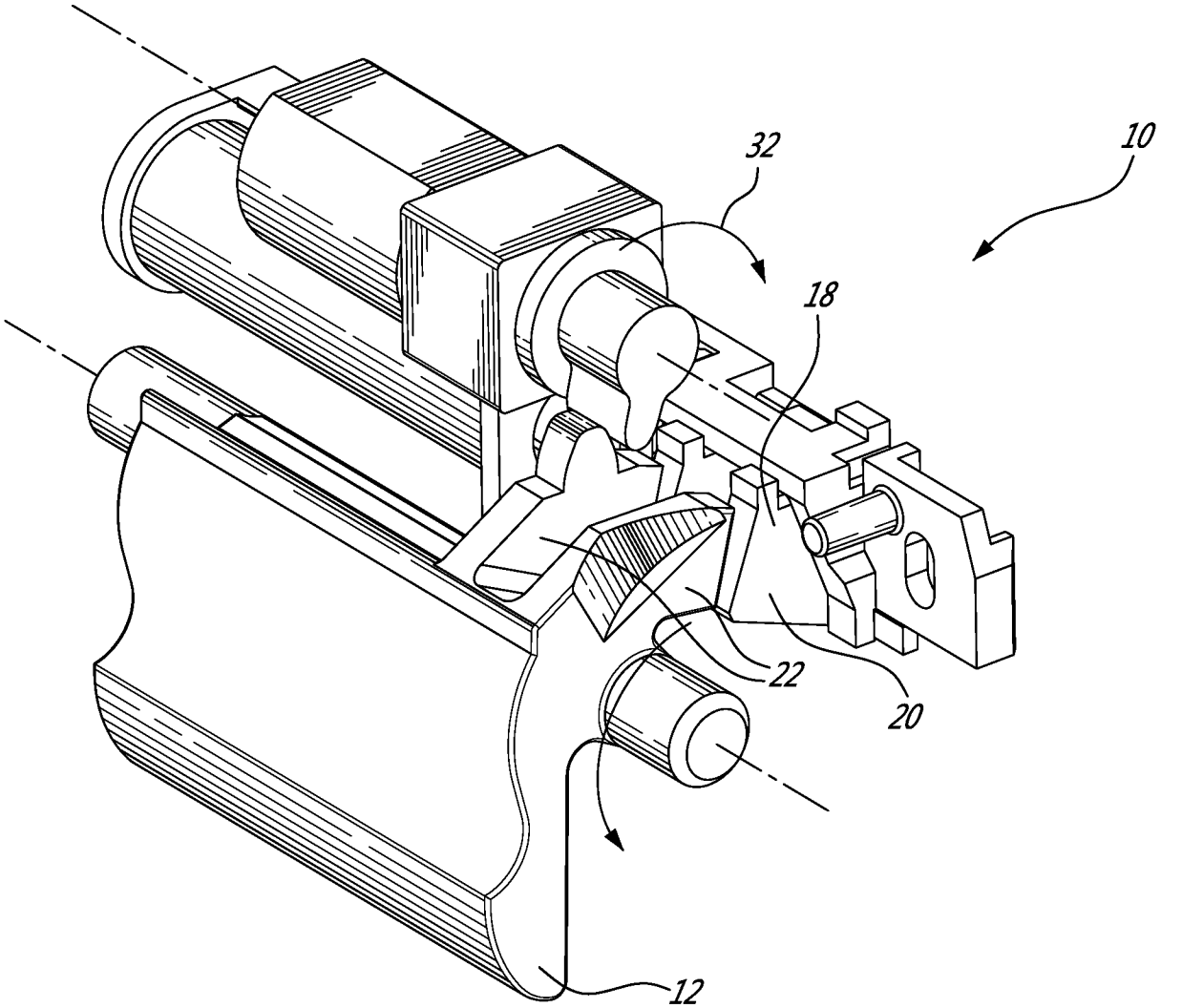
Figure 1C:
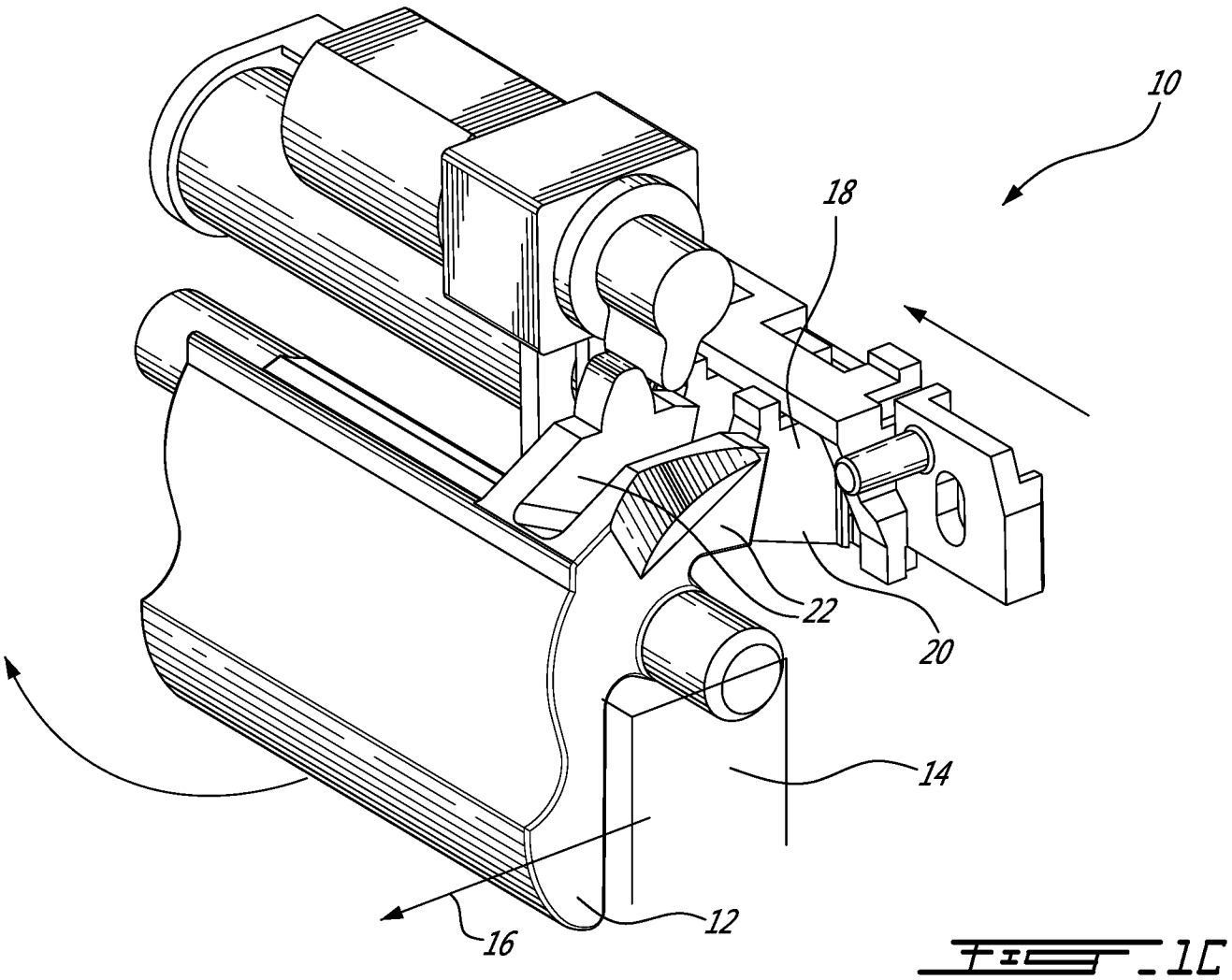

FIGS. 1A through 1C show an example of operation of an electronic access control strike 10 featuring an anti-preload action. More specifically, as shown in FIG. 1A, a keeper 12 is movably mounted in a frame which is not shown. In this embodiment, the keeper 12 is movable by pivoting, but it will be understood that in alternate embodiments, the keeper 12 can be movable by sliding. The purpose of the movement of the keeper is to yield to the bolt 14 (latchbolt) to allow the bolt 14 to exit the bolt socket and pivot, with the pivoting movement of the door, along the bolt path 16, when an authenticated user exerts a pivoting force on the door. However, the keeper movement ability must remain blocked in the absence of authentication, and only become unblocked if the user is authenticated. In other words, the keeper movement ability is contingent upon the authentication of the user. To this end, a moveable cam 18 can be provided to selectively be moved into a blocking and an unblocking position. In this specific example, the cam 18 is provided in the form of a two-pronged cam member 20, whereas the keeper 16 is provided with two corresponding prongs 22. When the cam member 18 is in the blocking position such as shown in FIG. 1A, the movement of the keeper 12 is blocked. More specifically, the pivoting movement of the keeper 12 to yield to the force exerted by the bolt is prevented because the keeper prongs 22 engage the cam prongs 20 and the cam prongs 20 exert an opposite resistance force.

The cam member 18 is slidably mounted in the frame to be slidable selectively into a blocking position such as shown in FIG. 1A and into an unblocking position such as shown in FIG. 1C. This sliding movement can be parallel to the pivot axis 24 of the keeper, and performed by a cam actuator 26, such as a solenoid, for instance. In the unblocking position, the cam prongs 20 are out from interference with the keeper prongs 22, and the keeper 12 is free to pivot in the direction indicated by the arrow 30 and yield to the movement of the bolt 14.

In some cases, the bolt 14 can apply a force against the keeper 12 such as shown in FIG. 1A independently of the action of the user. This can be caused by many sources such as presented above. When this occurs, the keeper prongs 22 are forced into engagement with the cam prongs 20. This force can cause a sufficient friction to cause the jamming of the slidability of the cam member, thus preventing the cam member 18 from being slid into the unblocking position when the user has been authenticated and the cam actuator 26 is operated. This can be frustrating and/or problematic to the user.

In this embodiment, this problem is addressed by a preload-negating feature. More specifically, a motor 36 is provided, connected to an anti-preload member 38. In this embodiment, the motor 36 is a rotary motor which moves the anti-preload member by rotating it. The motor is configured to pivot the anti-preload member 38 into engagement with the keeper 12, and to thereby exert a preload-negating motor force 32 (shown in FIG. 1B) which counters the preload force 30 and either satisfactorily compensates for, or annihilates, the force exerted by the keeper prongs 22 on the cam prongs 20, thereby restoring the sliding ability to the cam member 18 and allowing satisfactory actuation thereof by the cam actuator 26. In this embodiment, the motor axis 34 is parallel to the pivoting axis 24 of the keeper 12.

Figure 2A:
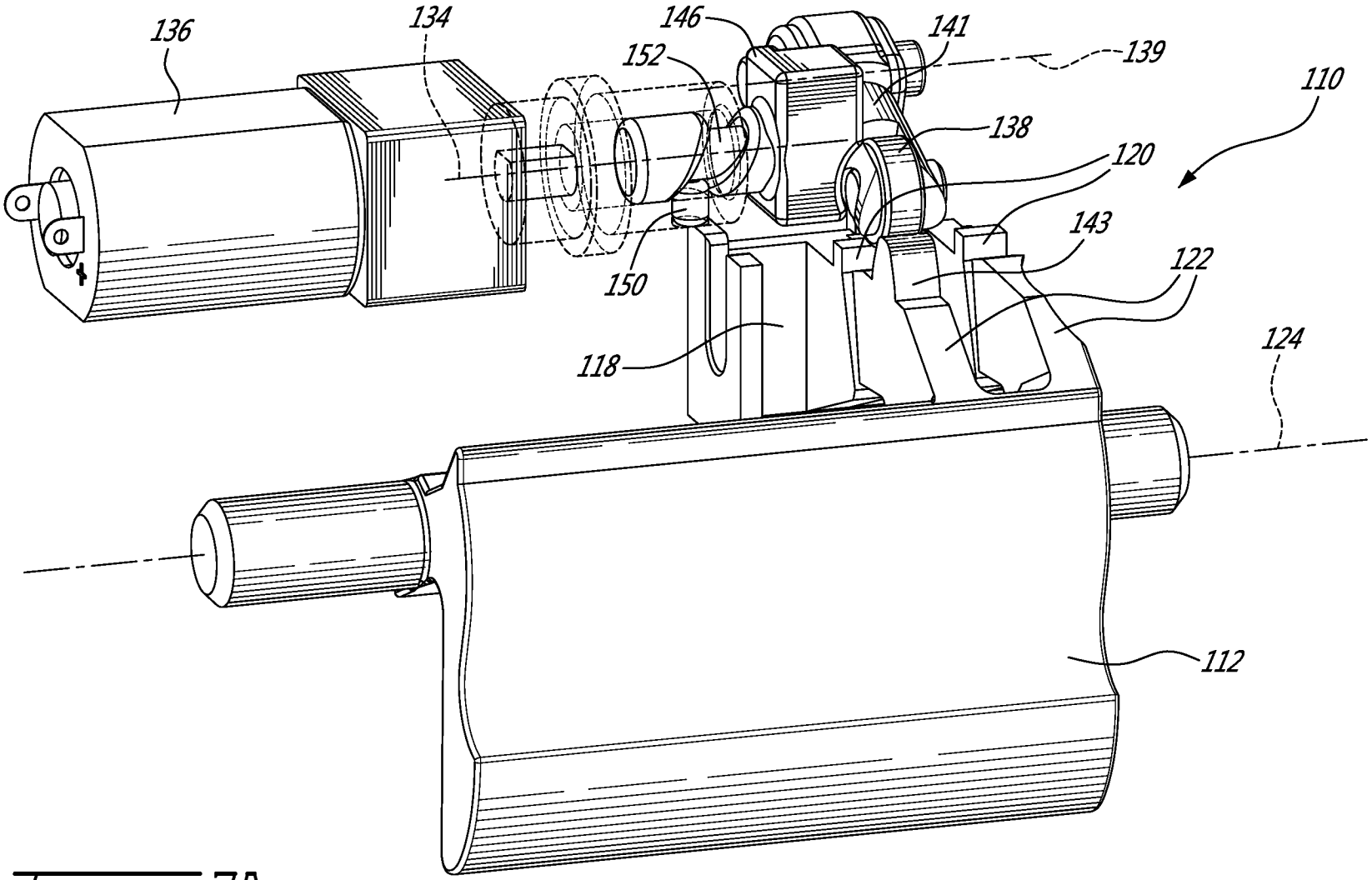
FIGS. 2A and 2B are sequential oblique views showing components of the electronic access control strike A) countering pre-load and B) releasing the bolt, in accordance with a second embodiment.

Another embodiment of an electronic access control strike 110 featuring an anti-preload action is shown in FIGS. 2A, 2B, 3A and 3B. More specifically, as shown in FIG. 2A, a keeper 112 is movably mounted in a frame which is not shown. In this embodiment, the keeper 112 is movable by pivoting, but it will be understood that in alternate embodiments, the keeper 112 can be movable by sliding. The purpose of the movement of the keeper is to yield to the bolt 114 (latchbolt) to allow the bolt 114 to exit the bolt socket and pivot, with the pivoting movement of the door, along the bolt path 116 (FIG. 3B), when an authenticated user exerts a pivoting force on the door. However, the keeper movement ability must remain blocked in the absence of authentication, and only become unblocked if the user is authenticated. In other words, the keeper movement ability is contingent upon the authentication of the user. To this end, a moveable cam 118 can be provided to selectively be moved into a blocking and an unblocking position. In this specific example, the cam 118 has two prongs 120, whereas the keeper 112 is provided with two corresponding prongs 122. When the cam member 118 is in the blocking position such as shown in FIG. 2A, the movement of the keeper 112 is blocked. More specifically, the pivoting movement of the keeper 112 to yield to the force exerted by the bolt 114 is prevented because the keeper prongs 122 engage the cam prongs 120 and the cam prongs 120 exert an opposite resistance force.

Figure 2B:
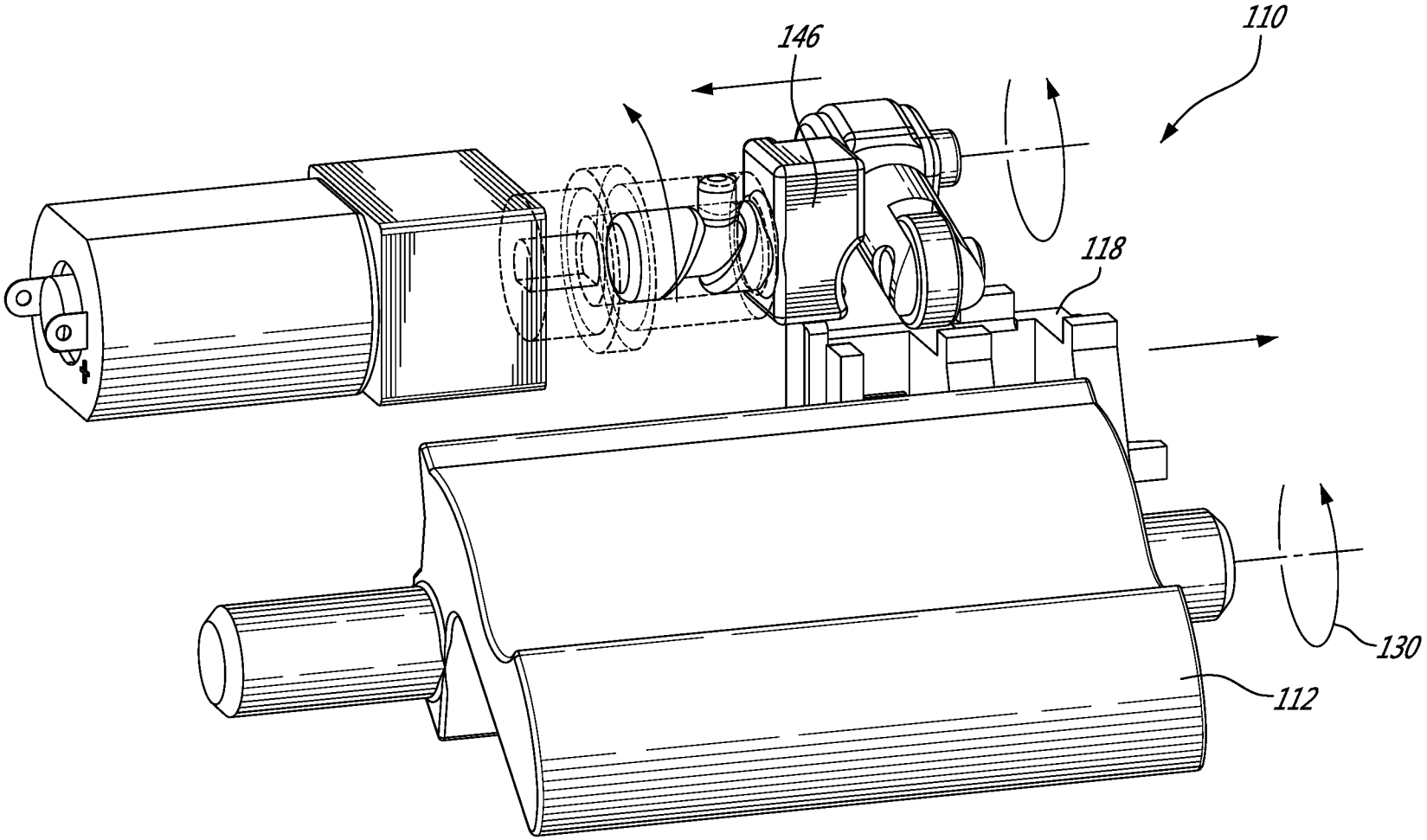
Figure 3A:
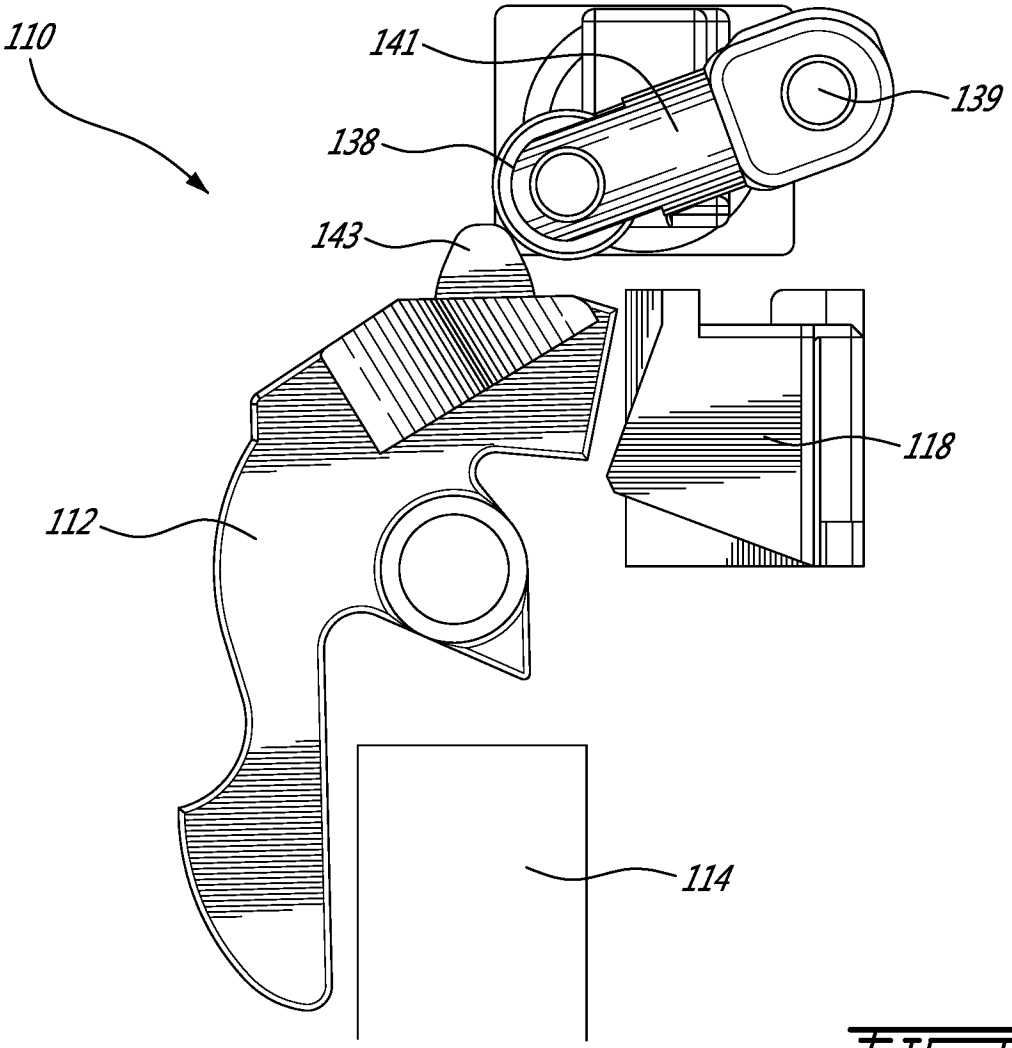
FIGS. 3A to 3C are sequential side views showing components of the electronic access control strike of FIGS. 2A and 2B A) countering pre-load B) releasing the keeper and C) releasing the bolt.
Figure 3B:
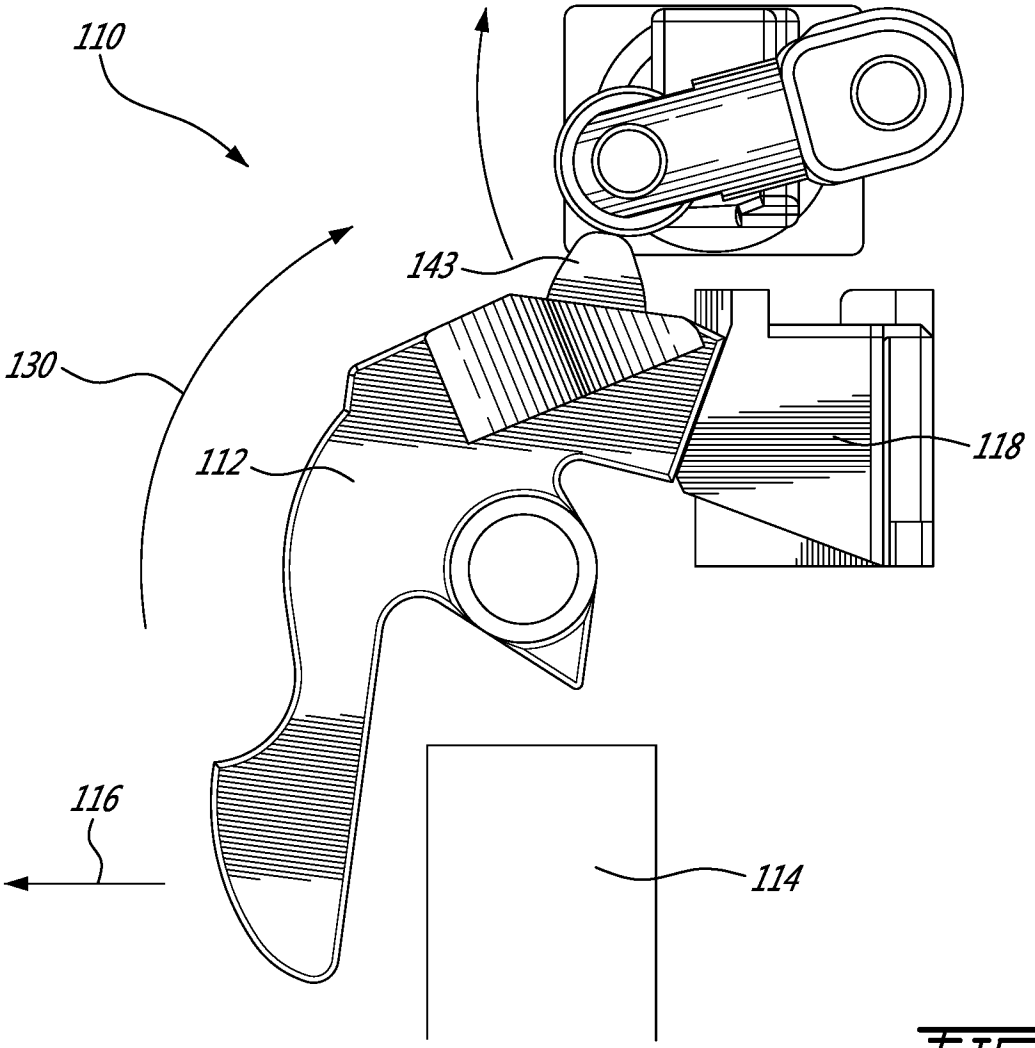
Figure 3C:
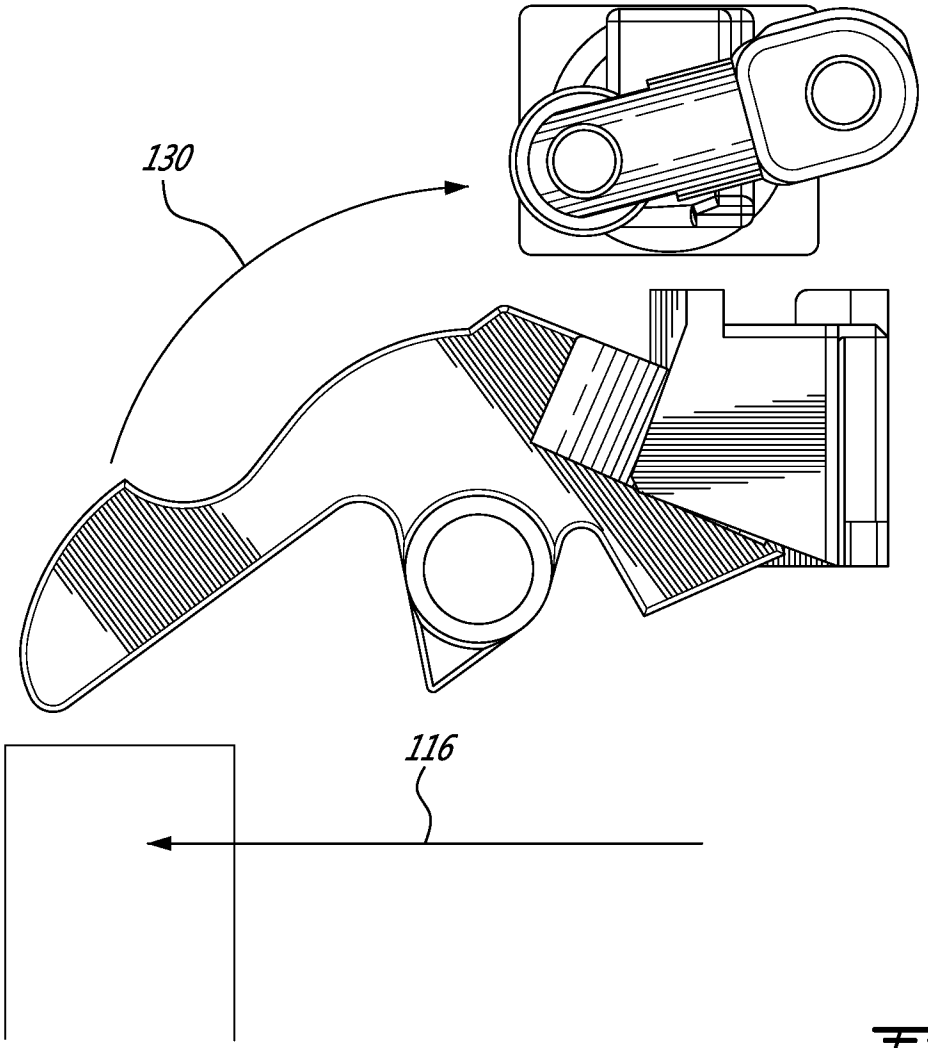

The cam member 118 is slidably mounted in the frame to be slidable selectively into a blocking position such as shown in FIG. 2A and into an unblocking position such as shown in FIG. 2B. This sliding movement can be parallel to the pivot axis 124 of the keeper, and performed by a cam actuator, such as a solenoid, for instance (not shown). In the unblocking position, the cam prongs 120 are out from interference with the keeper prongs 122, and the keeper 112 is free to pivot in the direction indicated by the arrow 130 and yield to the movement of the bolt 114.

In some cases, the bolt 114 can apply a force against the keeper 112 independently of the action of the user. This can be caused by many sources such as presented above. When this occurs, the keeper prongs 122 are forced into engagement with the cam prongs 120. This force can cause a sufficient friction to cause the jamming of the slidability of the cam member, thus preventing the cam member 118 from being slid into the unblocking position when the user has been authenticated and the cam actuator is operated. This can be frustrating and/or problematic to the user.

In this embodiment, this problem is addressed by a preload-negating feature. More specifically, an anti-preload member 138 is provided. The anti-preload member 138 is pivotally mounted to the frame and can pivot around pivot axis 139 via arm 141. In this embodiment, the anti-preload member 138 is biased to a blocking position such as shown in FIG. 2A, where it is in interference with the movement of an engagement feature, e.g. cam 143 (also referred to as tooth), of the keeper 112. A blocking member 146 is connected to a motor 136 and is activatable to block the anti-preload member 138 into the blocking position shown in FIG. 2A, which prevents a preloading force from forcing the keeper prongs 122 against the cam prongs. When the user is authenticated, the first step is then to move the cam prongs 120 into their disengaged position shown in FIG. 2B, and then, the blocking of the anti-preload member 138 is released via the motor. More specifically, in this embodiment, the motor is a rotary motor which rotates a radially-oriented key member 150 inside a helical key path 152 provided with the blocking member 146, and therefore retracts the blocking member 146 from the anti-preload member 138. The keeper 112 is then free to rotate by a force exerted by the user via the bolt 114, and the cam 143 of the keeper 112 pushes the freed anti-preload member 138 against the bias. This latter pushing action can be facilitated by using a freely rotating member on the anti-preload member 138 or on the cam 143 to reduce friction, in this embodiment, the anti-preload member 138 was provided with a freely rotating member to this end. Once the door closes and the keeper 112 reverts to its initial position, the anti-preload member 138 also pivots back to its initial position due to the bias (e.g. spring), and the motor 136 can be activated to move the blocking member 146 back into its blocking position. In this embodiment, the motor axis 134 is parallel to the pivoting axis 124 of the keeper 112.

Figure 4:
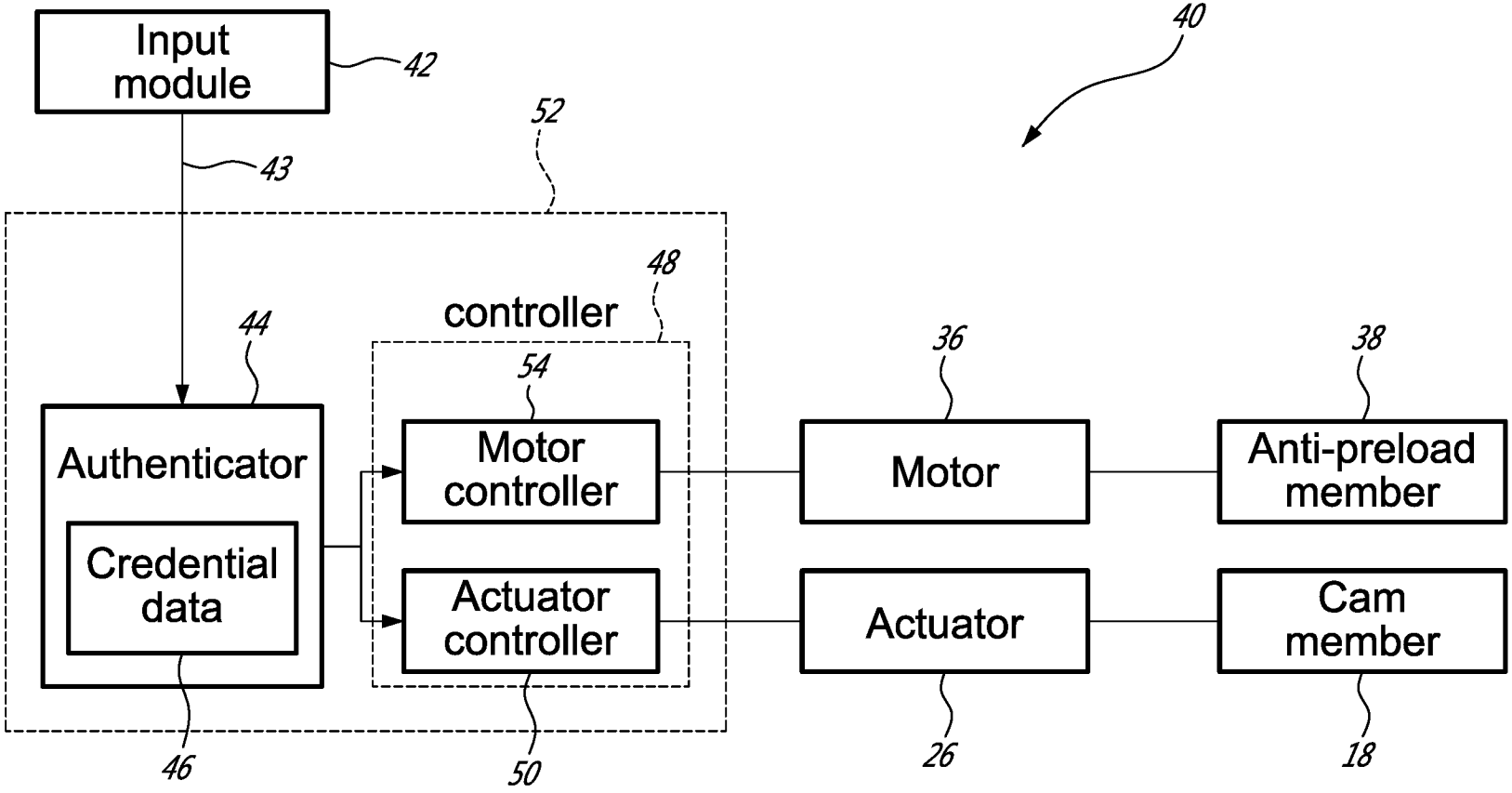
FIG. 4 is a block diagram of an example of an electronic access control strike.

FIG. 4 provides a higher-level and more complete schematic diagram of an electronic access control system 40 which is seen here to include an input module 42 for inputting the user data, an authenticator 44 to receive the user data 43 and authenticate it, such as by comparing it to credential data 46 for instance, and a controller system 48 which can coordinate the action of the motor 36 and the actuator 26 in a manner that the cam member 18 is operated while the preload negating force is being applied on the keeper 12 by the anti-preload member 38. Various alternate forms of detailed implementation can allow arriving to this general function. A relatively simple and practical way, as an example in relation with the first embodiment 10, is that the actuator controller 50 can operate the actuator 26 for a given period of time (e.g. 3-5 seconds), during which the motor 36 can be controlled to perform a complete rotation (which can last about 1 second for instance).

The authenticator 44 will typically involve some form of computer, and can be provided as a computer unit, or be provided as part of a larger computing system, for instance. The authentication can be done in situ, or by communicating remotely such as via the Internet, for instance. As an example, a computer 52 can perform each of the functions of receiving the user data 43, authenticating the user data against the credential data 46, and controlling the motor 36 and the actuator 26. In alternate embodiments, it can be preferred to provide the motor controller 54 and the actuator controller 50 as separate units which are enabled for communication with one another, or to collectively receive a command from the authenticator 44, to name a few examples.

Figure 5:
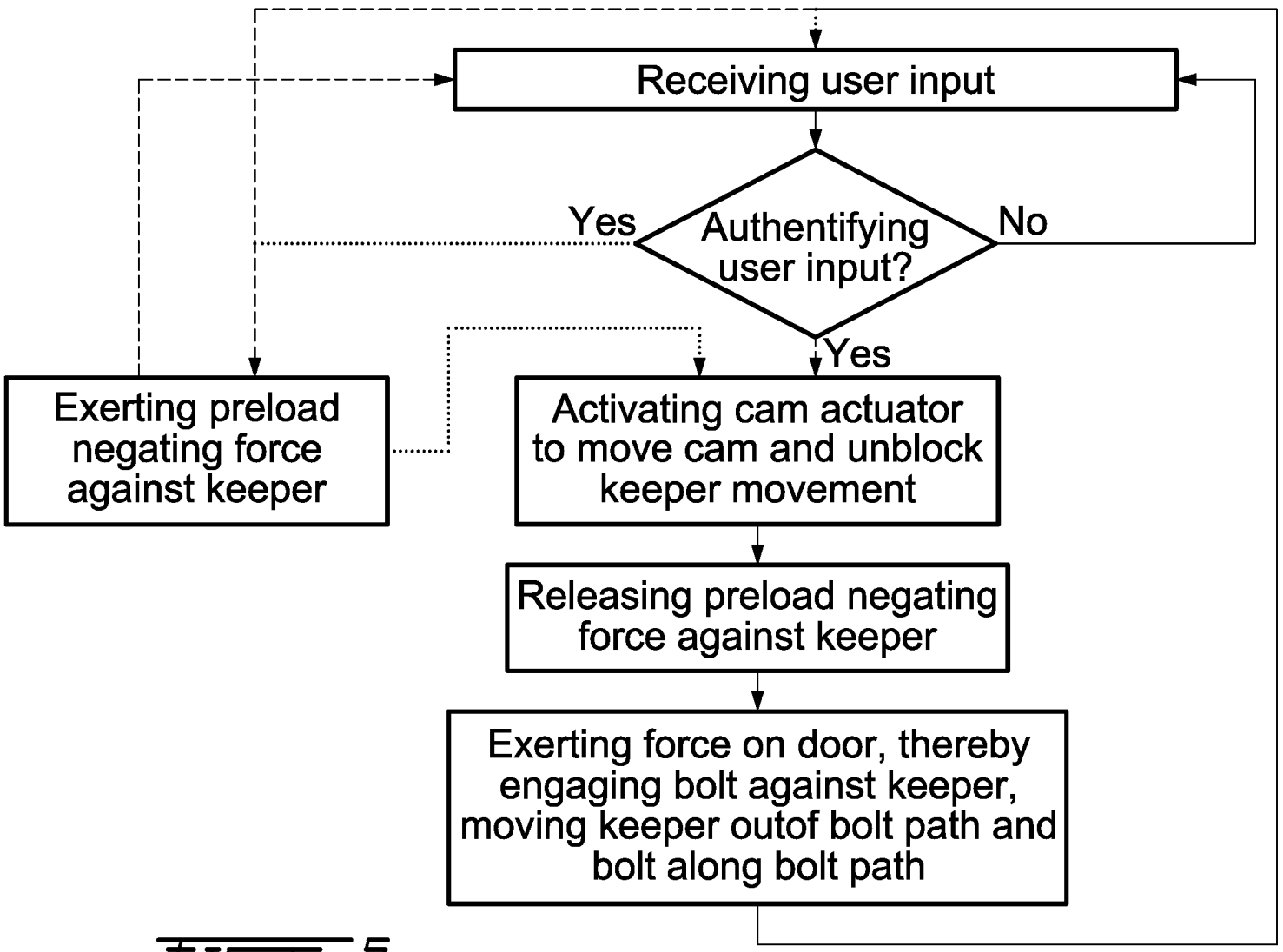
FIG. 5 is a flow chart illustrating the operation of an example of an electronic access control strike.

FIG. 5 provides a general flowchart of the operation of the electronic access control strike system 10 or 110 having the preload negating feature. As shown schematically, the cam movement occurs while the pivotable member exerts the preload negating force against the keeper, and the opening of the door by the user follows the cam movement. The relatively minor distinctions between the first embodiment 10 and the second embodiment 110 are illustrated by using different types of intermittent lines. More specifically, in the first embodiment 10, illustrated with dotted lines, and preload negating force is only exerted upon receiving the authentication, whereas in the second embodiment, the preload negating force can be readied soon after the closing of the door.

FIGS. 6A to 10 show an example of how a preload resistant module can be provided in a manner to be retrofittable to an existing electronic access control strike, although it will be understood that in an alternate embodiment, the preload-negating features, the motor and the pivotable member in particular, can be made integral to an electronic access control strike product, and housed in a common housing or frame.

Figure 6B:
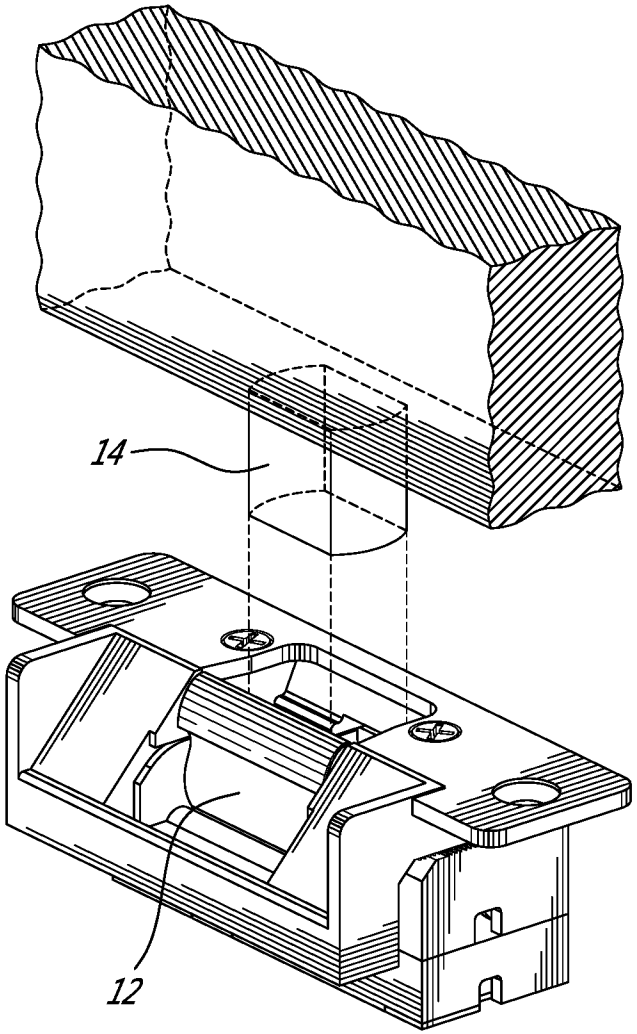
FIGS. 6A and 6B are an example of a preload-negating module being retrofitted to an electronic access control strike.
Figure 6A:
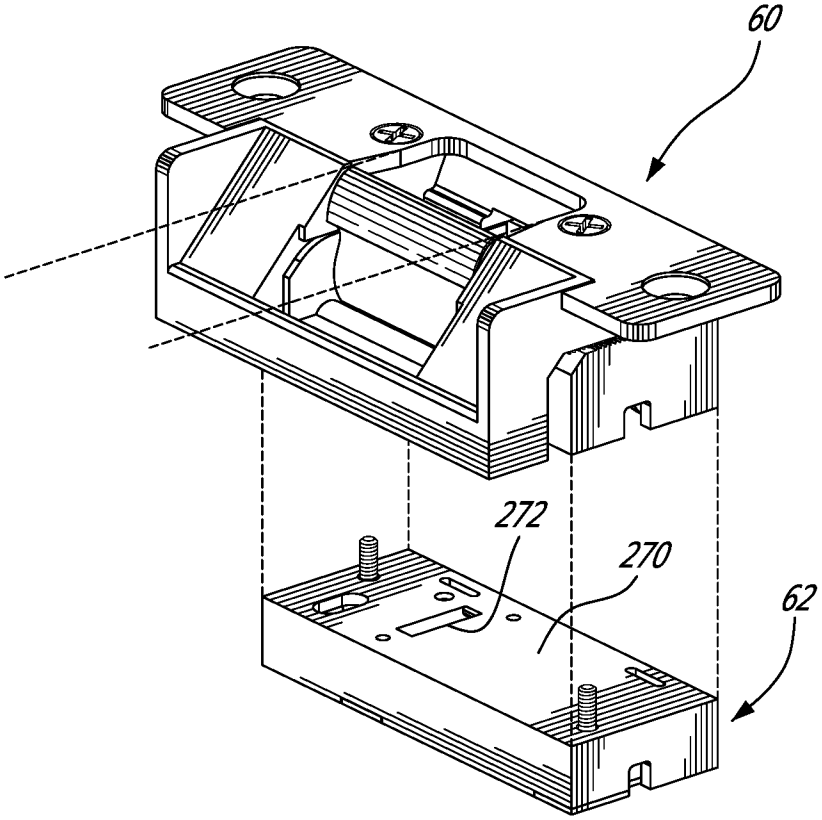
Figure 7:
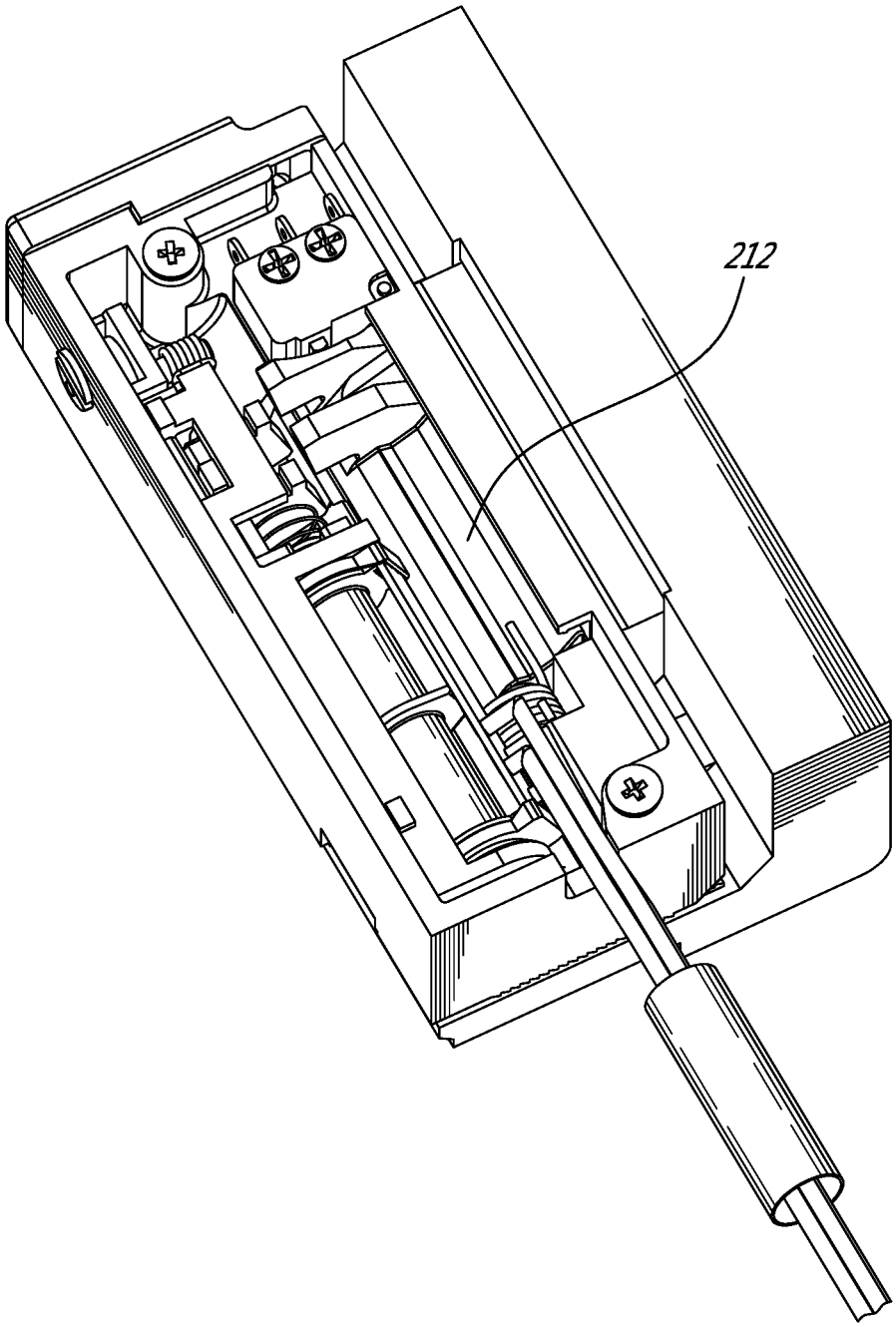
FIG. 7 is an example of an electronic access control strike, in accordance with a third embodiment.
Figure 9:
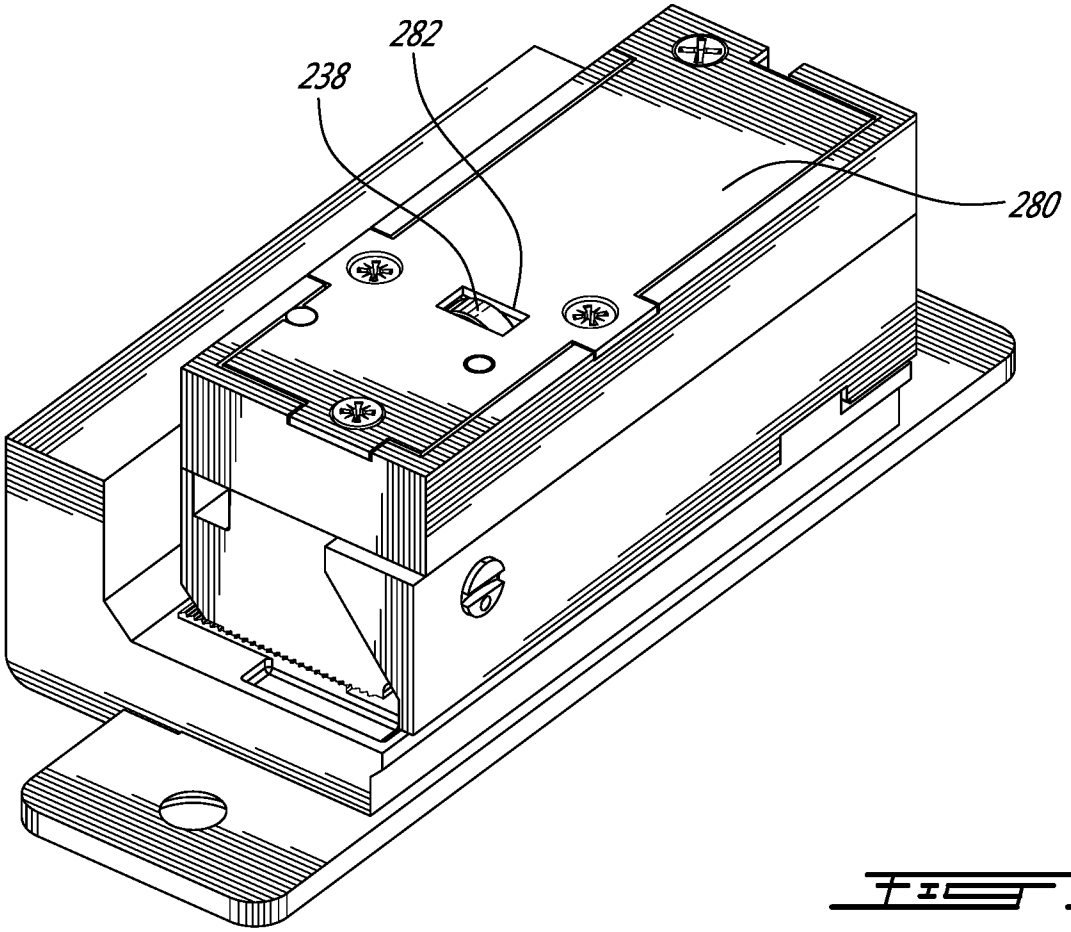

FIGS. 6A and 6B show the pre-existing electronic access control strike 60 and the preload resistant module 62 which can be provided as an add-on to problematic scenarios, for instance. In FIG. 6A, the two are shown disassembled, whereas in FIG. 6B, the two are shown assembled. FIGS. 7 and 9 show specifically the pre-existing electronic access control strike used in this example. As seen in FIG. 7, in this example, the keeper 212 of the pre-existing electronic access control strike does not have an engagement feature such as a tooth or cam, and it can be required to replace the pre-existing keeper 212 with a keeper such as keeper 12 or keeper 112 for instance, which has an engagement feature 43, 143, such as the one shown in FIG. 1A or 2A for instance.

Figure 8:
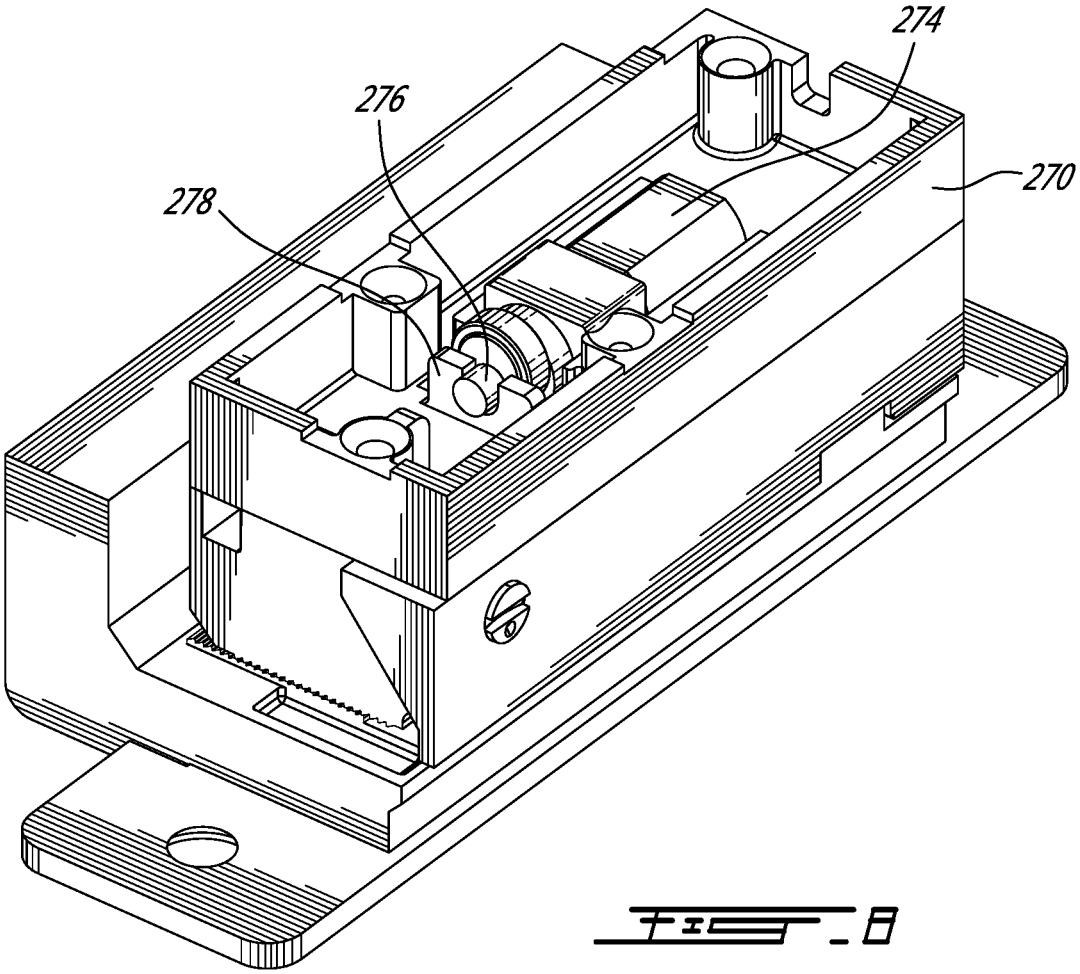
FIGS. 8 and 9 are additional views of a preload-negating module retrofitted to an electronic access control strike.
Figure 8A:
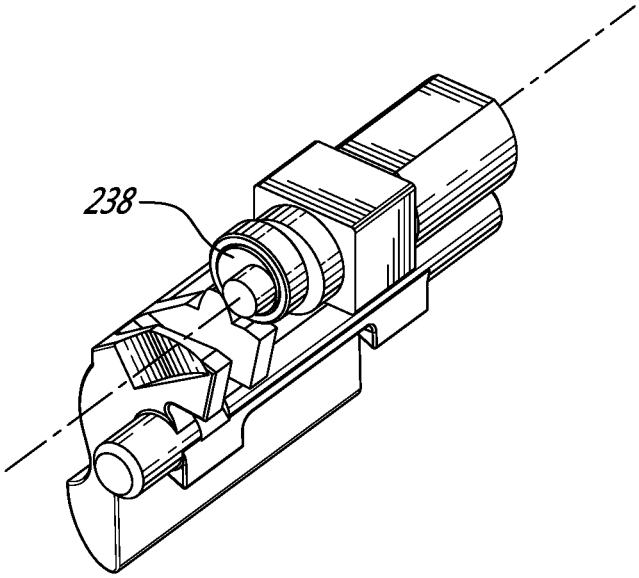
FIG. 8A shows the engagement of the pivotable member against the keeper.

Referring now to FIGS. 8 and 8A, in this example, the anti-preload member 238 can be provided in the form of a disc member which is offset from the rotation axis of the motor in a manner to pivot around the rotation axis upon operation of the motor. Referring back to FIG. 6A, the preload-negating module can have a standalone frame 270 within which the motor 26, 126, with the anti-preload member, are mounted. This frame 270 can be provided with an aperture such as a slot 272 (seen in FIG. 6A) through which the anti-preload member 38, 138, 238 can protrude (and/or across which the engagement feature 43, 143 of the keeper can protrude) to allow satisfactory engagement of the anti-preload member and engagement feature of the keeper 12, 112.

In this specific embodiment, such as shown more clearly in FIGS. 8 and 9, the motor 36, 136 has a base 274 which is secured within the frame 270 of the preload resistant module 62, and has a shaft 276 protruding outwardly from the anti-preload member. The shaft 276 is concentric with the axis of the motor whereas the anti-preload member, provided in the form of a disc rotatable with the motor in this third embodiment, is eccentric with the axis of the motor and the shaft. The frame 270 of the preload resistant module has a u-shaped neck 278 which is shaped to receive the shaft 276 and prevent the shaft 276 from moving laterally or toward the keeper. The frame 270 of the preload resistant module 62 is also provided with a cover 280 which snugly engages the motor and prevents the shaft 276 from disengaging from the u-shaped member 278 during operation. In this embodiment, the cover 280 is also provided with a slot 282 which clears the path of the pivoting member 238 (disc). This can allow a) to make the preload resistant module frame thinner and b) to visualise the movement of the disc during testing or installation, for instance.

Figure 10:
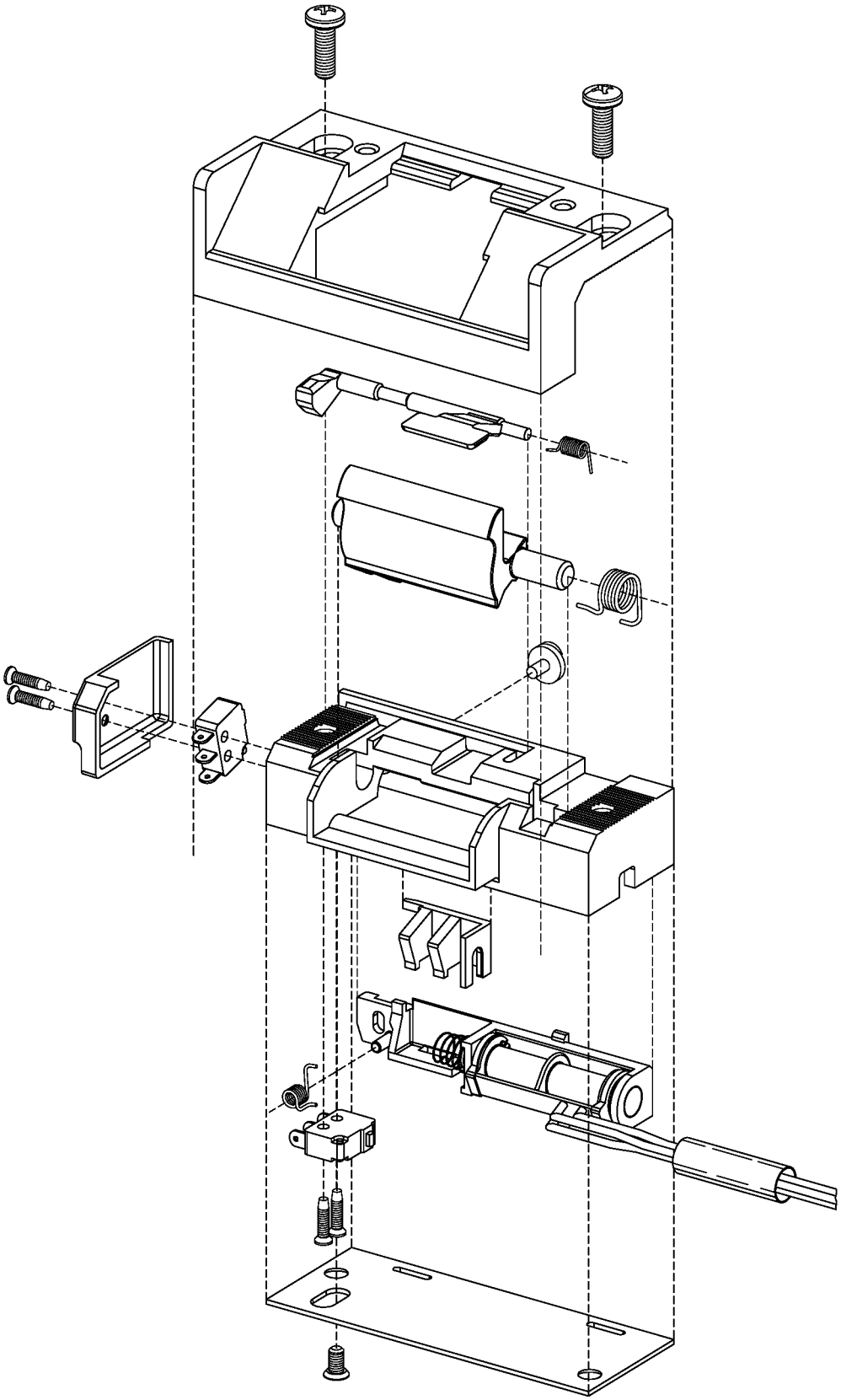
FIG. 10 is an exploded view of an example electronic access control strike.

Referring now to FIG. 10, more details of the pre-existing electronic access control strike selected for this example is shown. It will be noted that in this example, the keeper is biased into interference with the bolt path by a keeper spring. Moreover, the cam actuator is provided in the form of a solenoid which can pull the cam member against the elastic force of a cam spring, the cam spring biasing the cam member into the blocking position.

As can be understood, the examples described above and illustrated are intended to be exemplary only. For instance, in an alternate embodiment, the keeper can be slidable instead of pivotable, and selectively blocked or unblocked by any suitable mechanism. The scope is indicated by the appended claims.

What is claimed is:

1. An electronic access control strike having a bolt socket, a bolt path leading to bolt socket, a keeper pivotably mounted to a frame in a manner to be pivotable around a keeper pivot axis, into and out of interference with the bolt path, a blocker moveable in an orientation parallel to the keeper pivot axis for selectively blocking or unblocking the movement of the keeper, a motor, an anti-preload member which is pivotable around a motor axis about which the motor rotates and parallel to the keeper pivot axis, independently of the blocker, into interference between the keeper and the blocker for preventing the keeper from conveying a preload force onto the blocker when the blocker is in the blocking position, and pivotable, independently of the blocker, out from interference between the keeper and the blocker when the blocker is in the unblocking position to allow the keeper to be moved out from interference with the bolt path; and the motor controlling the movement of the anti-preload member.

2. The electronic access control strike of claim 1 wherein the keeper has an engagement feature spaced apart from the keeper pivot axis and configured to be engaged upon by the anti-preload member for receiving the force therefrom.

3. The electronic access control strike of claim 1 wherein the anti-preload member is pivotable by the motor into engagement with the keeper to exert a force against the keeper and move the keeper away from the blocker.

4. The electronic access control strike of claim 1 wherein the anti-preload member is biased to the interference position, and wherein the electronic access control strike further comprises a blocking member moveable to selectively block the anti-preload member in the interference position or release the anti-preload member from the interference position, the motor driving the movement of the blocking member.

5. The electronic access control strike of claim 4 wherein the movement of the blocking member is longitudinal and is driven by rotation of a key member by the motor, the key member being engaged in a helical keypath in the blocking member, the helical keypath being concentric with the motor axis.

6. The electronic access control strike of claim 1 further comprising an actuator controlling the movement of the blocker.

7. The electronic access control strike of claim 6 wherein the keeper member is biased into the bolt path, wherein the blocker is slidable, the actuator includes a solenoid for pulling the blocker into a first sliding direction, and a biasing member biasing the blocker in a second, opposite sliding direction when the solenoid is inactive.

8. The electronic access control strike of claim 6 further comprising an input module for receiving a user input, an authenticator to authenticate the user input, and a controller for operating the actuator contingent upon authentication of the user input.

9. The electronic access control strike of claim 1 further comprising an actuator controlling the movement of the blocker, and a controller coordinating the action of the motor and of the actuator in a manner that the actuator is activated when said anti-preload member is in the interference position.

* * * * *